US007946933B2

(12) United States Patent
Nanba et al.

(10) Patent No.: US 7,946,933 B2
(45) Date of Patent: May 24, 2011

(54) THREE-PIECE SOLID GOLF BALL

(75) Inventors: Atsushi Nanba, Chichibu (JP); Hiroshi Higuchi, Chichibu (JP); Toru Ogawana, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 11/930,560

(22) Filed: Oct. 31, 2007

(65) Prior Publication Data

US 2009/0111612 A1 Apr. 30, 2009

(51) Int. Cl.
*A63B 37/06* (2006.01)

(52) U.S. Cl. ..... 473/373

(58) Field of Classification Search ..... 473/373, 473/374, 376

See application file for complete search history.

(56) References Cited

U.S. PATENT DOCUMENTS

| | | | | |
|---|---|---|---|---|
| 5,553,852 | A | 9/1996 | Higuchi et al. | |
| 5,779,563 | A | 7/1998 | Yamagishi et al. | |
| 5,782,707 | A | 7/1998 | Yamagishi et al. | |
| 5,899,822 | A | 5/1999 | Yamagishi et al. | |
| 6,156,843 | A * | 12/2000 | Yokota | 525/221 |
| 6,248,028 | B1 | 6/2001 | Higuchi et al. | |
| 6,267,692 | B1 | 7/2001 | Higuchi et al. | |
| 6,267,694 | B1 | 7/2001 | Higuchi et al. | |
| 6,533,683 | B2 | 3/2003 | Watanabe | |
| 6,592,470 | B2 | 7/2003 | Shimosaka et al. | |
| 6,656,059 | B2 | 12/2003 | Umezawa et al. | |
| 6,659,889 | B2 | 12/2003 | Kasashima et al. | |
| 6,663,507 | B1 | 12/2003 | Watanabe et al. | |
| 6,679,791 | B2 | 1/2004 | Watanabe | |
| 6,702,694 | B1 | 3/2004 | Watanabe | |
| 6,702,695 | B1 | 3/2004 | Higuchi et al. | |
| 6,723,008 | B2 | 4/2004 | Higuchi et al. | |
| 6,739,986 | B2 | 5/2004 | Higuchi et al. | |
| 6,746,345 | B2 | 6/2004 | Higuchi et al. | |
| 6,746,347 | B2 | 6/2004 | Higuchi et al. | |
| 6,814,676 | B2 | 11/2004 | Ichikawa et al. | |
| 6,981,925 | B2 * | 1/2006 | Shimizu et al. | 473/376 |
| 2004/0072629 | A1 * | 4/2004 | Keller et al. | 473/374 |

FOREIGN PATENT DOCUMENTS

| | | | |
|---|---|---|---|
| JP | 07-024085 | A | 1/1995 |
| JP | 09-215775 | A | 8/1997 |
| JP | 10-151226 | A | 6/1998 |
| JP | 2910516 | B2 | 4/1999 |
| JP | 2002-000765 | A | 1/2002 |
| JP | 2002-085587 | A | 3/2002 |
| JP | 2002-085588 | A | 3/2002 |
| JP | 2002-085589 | A | 3/2002 |
| JP | 2002-186686 | A | 7/2002 |
| JP | 2002-191721 | A | 7/2002 |
| JP | 2002-219196 | A | 8/2002 |
| JP | 2002-315848 | A | 10/2002 |

(Continued)

*Primary Examiner* — Raeann Trimiew
(74) *Attorney, Agent, or Firm* — Sughrue Mion, PLLC

(57) ABSTRACT

The present invention provides a three-piece solid golf ball having a core molded under heat from a specific rubber composition and inner and outer cover layers encasing the core. By optimizing the core deflection under a specific load and the overall thickness of the cover layers, by forming the inner cover layer of a highly neutralized ionomer resin composition, and by optimizing within specific ranges the Shore D hardnesses of the inner cover layer and the outer cover layer, the spin rate of the ball on shots with a driver can be sufficiently reduced, enabling an increased distance to be achieved.

6 Claims, 1 Drawing Sheet

FOREIGN PATENT DOCUMENTS

Figure 1:
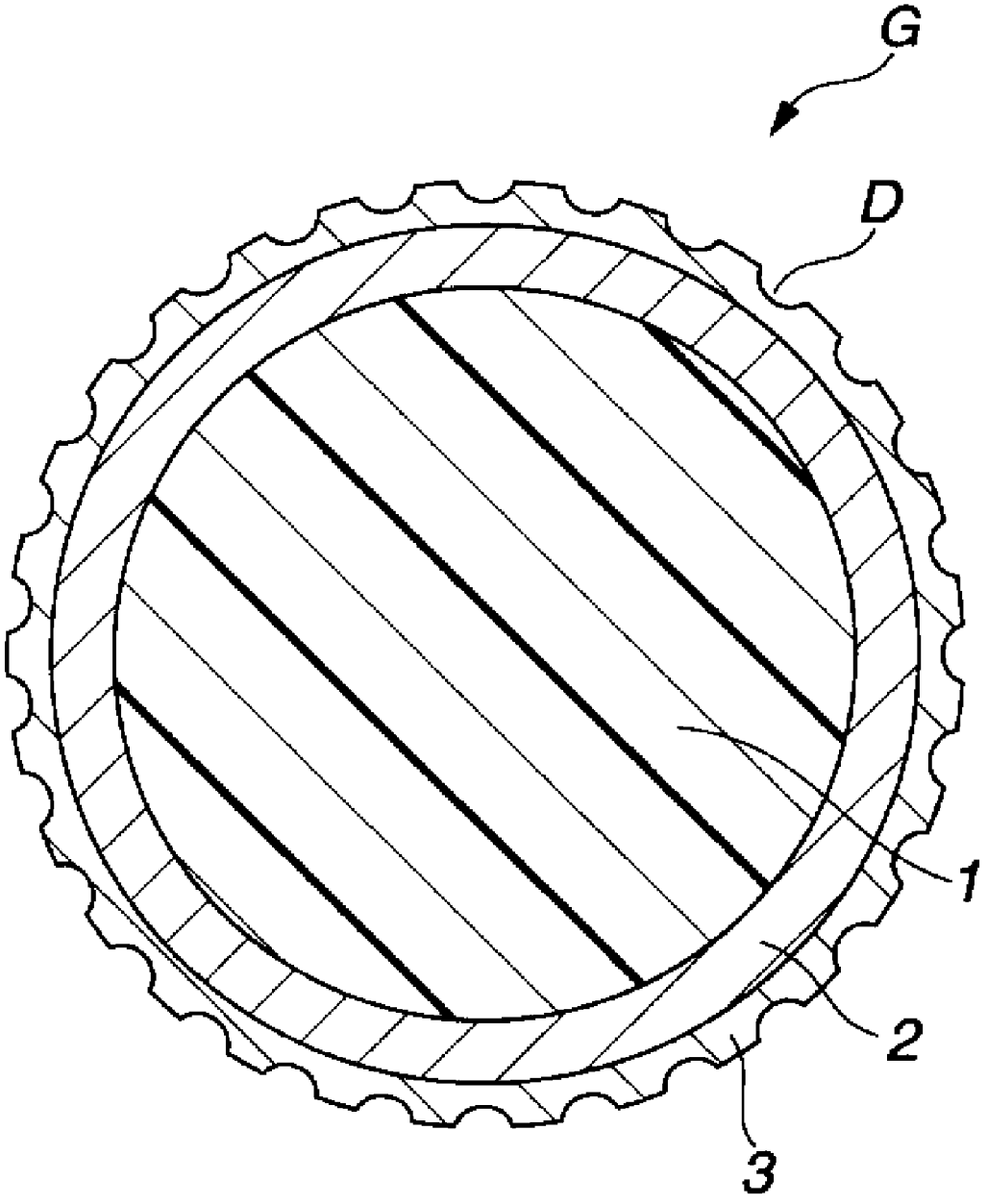

| | | | |
|---|---|---|---|
| JP | 2002-354999 | A | 12/2002 |
| JP | 2003-190330 | A | 7/2003 |
| JP | 3516123 | B2 | 1/2004 |
| JP | 3516124 | B2 | 1/2004 |
| JP | 3516125 | B2 | 1/2004 |
| JP | 2004-049913 | A | 2/2004 |
| JP | 2004-97802 | A | 4/2004 |
| JP | 3601582 | B2 | 10/2004 |
| JP | 3661812 | B2 | 4/2005 |
| JP | 3674679 | B2 | 5/2005 |
| JP | 2005-224514 | A | 8/2005 |
| JP | 2005-224515 | A | 8/2005 |

* cited by examiner

THREE-PIECE SOLID GOLF BALL

BACKGROUND OF THE INVENTION

The present invention relates to a three-piece golf ball having a core and a two-layer cover composed of an inner cover layer and an outer cover layer. More specifically, the invention relates to a three-piece solid golf ball which has a high initial velocity on shots taken with a driver, a low spin rate and an excellent distance.

Numerous golf balls with a three-piece construction that is hard on the inside and soft on the outside, including those described in the publications cited below, have hitherto been disclosed as solid golf balls which address the needs of professional golfers and skilled amateurs. Some of these prior-art golf balls also have improved spin properties, flight performance and durability.

JP-A 7-24085
JP-A 9-215775 (U.S. Pat. No. 5,779,563)
JP No. 3661812 (U.S. Pat. No. 5,782,707)
JP-A 10-151226 (U.S. Pat. No. 5,899,822)
JP-A 2002-191721
JP-A 2002-219196
JP No. 2910516 (U.S. Pat. No. 5,553,852)
JP No. 3516123 (U.S. Pat. No. 6,248,028)
JP No. 3516124 (U.S. Pat. No. 6,267,692)
JP No. 3516125 (U.S. Pat. No. 6,267,694)
JP No. 3601582 (U.S. Pat. No. 6,702,695)
JP-A 2002-85588 (U.S. Pat. No. 6,746,345)
JP-A 2002-85589 (U.S. Pat. No. 6,723,008)
JP-A 2002-85587 (U.S. Pat. No. 6,739,986)
JP-A 2002-186686 (U.S. Pat. No. 6,746,347)
JP No. 3674679 (U.S. Pat. No. 6,533,683)
JP-A 2002-765 (U.S. Pat. No. 6,679,791)
JP-A 2002-315848 (U.S. Pat. No. 6,592,470)
JP-A 2003-190330 (U.S. Pat. No. 6,814,676)
JP-A 2004-049913 (U.S. Pat. No. 6,663,507)
JP-A 2004-97802 (U.S. Pat. No. 6,702,694)
JP-A 2002-345999 (U.S. Pat. No. 6,656,059)
JP-A 2005-224514
JP-A 2005-224515
U.S. Pat. No. 6,659,889

However, the improvements achieved in the foregoing three-piece solid golf balls still fall short in some respects. Further improvements are desired in the balance between the distance traveled by the ball on shots with a W#1 and spin controllability, and in durability.

In addition, various golf balls with multilayer covers have been described in U.S. Pat. Nos. 5,833,553, 6,126,559, 6,220,972, 6,561,928 and 6,309,314. However, there is still room for improvement in terms of increased distance on shots taken with a driver and the feel of the ball on impact.

SUMMARY OF THE INVENTION

It is therefore an object of the present invention to provide a three-piece solid golf ball which has an improved ball rebound, has a spin rate on shots with a driver that is sufficiently reduced, thereby increasing the total distance traveled by the ball, and also has a good feel on impact.

As a result of extensive investigations, the inventor has discovered that, in three-piece solid golf balls, by having the cover composed of an inner cover layer made primarily of a highly neutralized ionomer and an outer cover layer of substantial thickness, the rebound of the ball is improved and a spin rate-lowering effect is achieved on shots taken with a driver. In other words, a distance-increasing effect is achieved. The inventor has also found that such golf balls have a good feel on impact.

Accordingly, the invention provides the following three-piece solid golf balls.

[1] A three-piece solid golf ball comprising a core obtained by molding under heat a rubber composition comprised of a base rubber, a filler, an organic peroxide, an antioxidant and an α,β-unsaturated carboxylic acid, and an inner cover layer and outer cover layer which encase the core and are made of a thermoplastic resin material, wherein the core has a deflection when compressed under a final load of 1,275 N (130 kgf) from an initial load state of 98 N (10 kgf) of at least 2.6 mm but not more than 3.2 mm; the inner cover layer has a Shore D hardness of more than 58 and is formed of a heated mixture having a melt index of at least 1.0 dg/min and comprising:

100 parts by weight of one or a mixture of (a) an olefin-unsaturated carboxylic acid random copolymer and/or an olefin-unsaturated carboxylic acid-unsaturated carboxylic acid ester random copolymer, and (d) a metal ion neutralization product of an olefin-unsaturated carboxylic acid random copolymer and/or a metal ion neutralization product of an olefin-unsaturated carboxylic acid-unsaturated carboxylic acid ester random copolymer, (b) from 5 to 80 parts by weight of a fatty acid or fatty acid derivative having a molecular weight of at least 228, and (c) from 0.1 to 10 parts by weight of a basic inorganic metal compound which is capable of neutralizing acid groups in components (a) and/or (d) and in component (b);

the outer cover layer has a Shore D hardness of 58 or less; and the cover layers have a combined thickness of at least 3.5 mm.

[2] The three-piece solid golf ball of [1], wherein the outer cover layer is formed by injection-molding a single resin blend comprising (A) a thermoplastic polyurethane and (B) a polyisocyanate compound, which resin blend contains a polyisocyanate compound in at least some portion of which all the isocyanate groups on the molecule remain in an unreacted state.

[3] The three-piece solid golf ball of [2], wherein the outer cover layer-forming resin blend further comprises (C) a thermoplastic elastomer other than a thermoplastic polyurethane.

BRIEF DESCRIPTION OF THE DIAGRAMS

FIG. 1 is a schematic cross-sectional view of a three-piece solid golf ball according to one embodiment of the invention.

DETAILED DESCRIPTION OF THE INVENTION

The invention is described more fully below.

The three-piece solid golf ball of the invention is a three-layer structure having a core and two cover layers which encase the core.

The core in the invention may be a rubber core that has been molded and vulcanized from a rubber composition containing primarily a commonly used base rubber. Specifically, a material molded and vulcanized from a rubber composition containing as the essential ingredients a base rubber, a filler, an organic peroxide, an antioxidant and an α,β-unsaturated carboxylic acid serves as the golf ball core.

It is preferable here for the core to be made of a rubber composition. Polybutadiene is preferably used as the base rubber in the rubber composition. A preferred example of this polybutadiene is 1,4-cis polybutadiene having a cis structure content of at least 40%. If desired, other types of rubber, such as natural rubber, polyisoprene rubber or styrene-butadiene rubber may be suitably blended with the foregoing polybutadiene in this base rubber. The rebound of the golf ball can be improved by increasing the amount of the rubber ingredients.

An α,β-unsaturated carboxylic acid compound such as zinc methacrylate or zinc acrylate may be included in the rubber composition as a crosslinking agent. The use of zinc acrylate is especially preferred. The amount of such unsaturated carboxylic acid compounds included per 100 parts by weight of the base rubber is preferably at least 10 parts by weight, and more preferably at least 20 parts by weight, but preferably not more than 50 parts by weight, and more preferably not more than 39 parts by weight.

A vulcanizing agent is included in the rubber composition. The vulcanizing agent used is preferably an organic peroxide and/or sulfur. Illustrative examples of the organic peroxide include commercial products such as Perhexa 3M (produced by NOF Corporation), Percumyl D (produced by NOF Corporation), and Luperco 231XL and Luperco 101XL (both products of Atochem Co.). Any one or mixtures of two or more of these may be used. The amount included per 100 parts by weight of the base rubber is preferably at least 0.2 part by weight, more preferably at least 0.4 part by weight, and even more preferably at least 0.6 part by weight, but preferably not more than 2.0 parts by weight, more preferably not more than 1.5 parts by weight, even more preferably not more than 1.2 parts by weight, and most preferably not more than 0.9 part by weight.

In addition, an antioxidant is included. Illustrative examples of the antioxidant include commercial antioxidants such as Nocrac NS-6, Nocrac NS-30 and Nocrac SP-N (all products of Ouchi Shinko Chemical Industry Co., Ltd.), and Yoshinox 425 (produced by Yoshitomi Pharmaceutical Industries, Ltd.). These may be used singly or as combinations of two or more thereof.

Illustrative, non-limiting, examples of the filler included in the rubber composition are zinc oxide, barium sulfate and calcium carbonate.

The core composition obtained by compounding the above ingredients is generally masticated using a mixing apparatus such as a Banbury mixer or roll mill, following which the masticated material is compression-molded or injection-molded in a core mold, and the resulting molded body is cured by suitably heating at a temperature sufficient for the crosslinking agent and co-crosslinking agent to act, thereby producing a core having the desired hardness profile. To illustrate, when dicumyl peroxide is used as the crosslinking agent and zinc acrylate is used as the co-crosslinking agent, heating is typically carried out at from 130 to 170° C., and preferably from 150 to 160° C., for a period of from 10 to 40 minutes, and preferably from 12 to 20 minutes.

The core may be produced by using a known method to vulcanize and cure the rubber composition. The diameter of the core is set to preferably at least 35.0 mm, more preferably at least 35.5 mm, and even more preferably at least 36.0 mm, but preferably not more than 38.5 mm, more preferably not more than 38.0 mm, and even more preferably not more than 37.5 mm.

In the present invention, the core has a deflection, when compressed under a final load of 1,275 N (130 kgf) from an initial load state of 98 N (10 kgf), of at least 2.6 mm but not more than 3.2 mm. The lower limit of this value is preferably 2.7 mm or more. The upper limit value is preferably not more than 3.1 mm, and more preferably not more than 3 mm. If the core is softer than the above range, it will have a poor rebound. On the other hand, if the core is harder than the above range, the ball will have a poor feel on impact.

The difference between the JIS-C hardness at the center of the core and the JIS-C hardness at the surface of the core may be optimized. The hardness difference obtained by subtracting the JIS-C hardness at the core center from the JIS-C hardness at the core surface is preferably 15 or more, more preferably 20 or more, and even more preferably 23 or more. The upper limit is preferably 40 or less, more preferably 37 or less, and even more preferably 35 or less. At a JIS-C hardness difference larger than 15, the spin rate of the ball may become excessive, as a result of which the ball may assume a high trajectory and may thus be subject to wind effects. On the other hand, at a JIS-C hardness difference larger than 40, the durability of the ball to impact may decrease.

In the present invention, two cover layers encase the core. That is, referring to FIG. 1, the ball has a construction G in which an inner cover layer 2 directly envelopes a core 1, and an outer cover layer 3 is positioned on the surface side of the ball. A plurality of dimples D are generally formed on the outside surface of the outer cover layer 3.

Next, the materials making up the respective cover layers are described in detail below, beginning with the inner cover layer and followed by the outer cover layer.

Inner Cover Layer Material

In the invention, the inner cover layer is made of a resin composition which includes as the essential components:

100 parts by weight of one or a mixture of (a) an olefin-unsaturated carboxylic acid random copolymer and/or an olefin-unsaturated carboxylic acid-unsaturated carboxylic acid ester random copolymer, and (d) a metal ion neutralization product of an olefin-unsaturated carboxylic acid random copolymer and/or a metal ion neutralization product of an olefin-unsaturated carboxylic acid-unsaturated carboxylic acid ester random copolymer;

(b) from 5 to 80 parts by weight of a fatty acid or fatty acid derivative having a molecular weight of at least 228; and (c) from 0.1 to 10 parts by weight of a basic inorganic metal compound which is capable of neutralizing acid groups in components (a) and/or (d) and in component (b).

Above components (a) to (d) are described below.

Component (a) is an olefin-unsaturated carboxylic acid random copolymer and/or an olefin-unsaturated carboxylic acid-unsaturated carboxylic acid ester random copolymer. Component (d) is a metal ion neutralization product of an olefin-unsaturated carboxylic acid random copolymer and/or a metal ion neutralization product of an olefin-unsaturated carboxylic acid-unsaturated carboxylic acid ester random copolymer. Either of these components may be used alone or above components (a) and (d) may be used together.

The olefin in component (a) has a number of carbons which is generally at least 2 but not more than 8, and preferably not more than 6. Specific examples include ethylene, propylene, butene, pentene, hexene, heptene and octene. Ethylene is especially preferred.

Examples of the unsaturated carboxylic acid include acrylic acid, methacrylic acid, maleic acid and fumaric acid. Acrylic acid and methacrylic acid are especially preferred.

The unsaturated carboxylic acid ester is preferably a lower alkyl ester of the above unsaturated carboxylic acid. Specific examples include methyl methacrylate, ethyl methacrylate, propyl methacrylate, butyl methacrylate, methyl acrylate, ethyl acrylate, propyl acrylate and butyl acrylate. Butyl acrylate (n-butyl acrylate, i-butyl acrylate) is especially preferred.

The random copolymer of component (a) may be prepared by using a known process to randomly copolymerize the above ingredients. It is recommended that the unsaturated carboxylic acid content (acid content) within the random copolymer be preferably at least 2 wt %, more preferably at least 6 wt %, and even more preferably at least 8 wt %, but preferably not more than 25 wt %, more preferably not more than 20 wt %, and even more preferably not more than 15 wt %. A low acid content may lower the resilience of the material, whereas a high acid content may lower the processability of the material.

The neutralization product of a random copolymer may be prepared as component (d) by neutralizing some of the acid groups in the above-described random copolymer with metal ions. Examples of metal ions which may be used to neutralize the acid groups include $Na^+$, $K^+$, $Li^+$, $Zn^{++}$, $Cu^{++}$, $Mg^{++}$, $Ca^{++}$, $Co^{++}$, $Ni^{++}$ and $Pb^{++}$. The use of ions such as $Na^+$, $Li^+$, $Zn^{++}$ and $Mg^{++}$ is preferred. $Zn^{++}$ is especially preferred. The degree of neutralization of the random copolymer by these metal ions is not particularly limited. Such neutralization products may be prepared using a method known to the art. For example, the metal ions may be introduced onto the random copolymer using such compounds as formates, acetates, nitrates, carbonates, bicarbonates, oxides, hydroxides or alkoxides of the above metal ions.

Illustrative examples of the random copolymer serving as component (a) include Nucrel AN4311, Nucrel AN4318, Nucrel 1560 and Nucrel AN4213C (all produced by DuPont-Mitsui Polychemicals Co., Ltd.). Illustrative examples of the neutralization products of random copolymers serving as component (d) include Himilan 1554, Himilan 1557, Himilan 1601, Himilan 1605, Himilan 1706, Himilan 1855, Himilan 1856 and Himilan AM7316 (all products of DuPont-Mitsui Polychemicals Co., Ltd.); and also Surlyn 6320, Surlyn 7930 and Surlyn 8120 (all products of E.I. DuPont de Nemours & Company). Zinc-neutralized ionomer resins, such as Himilan AM7316, are especially preferred.

A random copolymer of the type described above for component (a), a neutralization product of the type described above for component (d), or a combination of both may be used as the base resin in the inner cover layer material. Where both are used in combination, the proportions in which they are blended are not subject to any particular limitation.

Of the above components (a) and (d), resin materials composed of an olefin-unsaturated carboxylic acid random copolymer (a binary random copolymer) and/or a metal salt thereof have a Shore D hardness of preferably at least 58, and resin materials composed of an olefin-unsaturated carboxylic acid-unsaturated carboxylic acid ester random copolymer (a ternary random copolymer) and/or a metal salt thereof have a Shore D hardness of preferably not more than 55. The upper limit in the hardness of the resin material composed of the above-described binary random copolymer and/or a metal salt thereof is preferably 70 or less, and more preferably 68 or less. The lower limit in the hardness of the resin material composed of the above-described ternary random copolymer and/or a metal salt thereof is preferably at least 20, and more preferably at least 25.

Component (b) is a fatty acid or fatty acid derivative having a molecular weight of at least 228 whose purpose is to enhance the flow properties of the resin composition. It has a molecular weight which is much smaller than that of the thermoplastic resin of component (a), and helps to significantly lower the melt viscosity of the mixture. Also, because the fatty acid (or fatty acid derivative) has a molecular weight of at least 228 and has a high content of acid groups (or derivative moieties thereof), its addition to the resin material results in little if any loss of resilience.

The molecular weight of the fatty acid or fatty acid derivative used as component (b) is at least 228, preferably at least 256, more preferably at least 280, and even more preferably at least 300, but generally not more than 1,500, preferably not more than 1,000, more preferably not more than 600, and even more preferably not more than 500. A molecular weight which is too low will make it impossible to improve the heat resistance of the resin composition. On the other hand, if the molecular weight is too high, component (b) will be unable to improve the flow properties of the resin composition.

The fatty acid or fatty acid derivative serving as component (b) may be an unsaturated fatty acid or fatty acid derivative having a double bond or triple bond in the alkyl moiety, or it may be a saturated fatty acid or fatty acid derivative in which all the bonds in the alkyl moiety are single bonds. It is recommended that the number of carbon atoms on the molecule be preferably at least 18, more preferably at least 20, even more preferably at least 22, and most preferably at least 24, but preferably not more than 80, more preferably not more than 60, even more preferably not more than 40, and most preferably not more than 30. Too few carbons may make it impossible to achieve an improved heat resistance, and may also set the acid group content so high as to cause the acid groups to interact with acid groups present on the base resin, diminishing the flow-improving effects. On the other hand, too many carbons increases the molecular weight, which may significantly lower the flow-improving effects.

Specific examples of fatty acids that may be used as component (b) include stearic acid, 12-hydroxystearic acid, behenic acid, oleic acid, linoleic acid, linolenic acid, arachidic acid and lignoceric acid. Of these, stearic acid, arachidic acid, behenic acid and lignoceric acid are preferred.

Fatty acid derivatives are exemplified by derivatives in which the proton on the acid group of the fatty acid has been substituted. Exemplary fatty acid derivatives of this type include metallic soaps in which the proton has been substituted with a metal ion. Metal ions that may be used in such metallic soaps include $Li^+$, $Ca^{++}$, $Mg^{++}$, $Zn^{++}$, $Mn^{++}$, $Al^{+++}$, $Ni^{++}$, $Fe^{++}$, $Fe^{+++}$, $Cu^{++}$, $Sn^{++}$, $Pb^{++}$ and $Co^{++}$. Of these, $Ca^{++}$, $Mg^{++}$ and $Zn^{++}$ are especially preferred.

Specific examples of fatty acid derivatives that may be used as component (b) include magnesium stearate, calcium stearate, zinc stearate, magnesium 12-hydroxystearate, calcium 12-hydroxystearate, zinc 12-hydroxystearate, magnesium arachidate, calcium arachidate, zinc arachidate, magnesium behenate, calcium behenate, zinc behenate, magnesium lignocerate, calcium lignocerate and zinc lignocerate. Of these, magnesium stearate, calcium stearate, zinc stearate, magnesium arachidate, calcium arachidate, zinc arachidate, magnesium behenate, calcium behenate, zinc behenate, magnesium lignocerate, calcium lignocerate and zinc lignocerate are preferred.

Moreover, use may also be made of known metallic soap-modified ionomers, including those described in U.S. Pat. No. 5,312,857, U.S. Pat. No. 5,306,760 and International Disclosure WO 98/46671, in combination with above components (a) and/or (d) and component (b).

A basic inorganic filler capable of neutralizing acid groups in above component (a) and/or (d) and above component (b) is added as component (c). When component (a) and/or (d) and component (b) alone, and in particular a metal-modified ionomer resin alone (e.g., a metal soap-modified ionomer resin of the type mentioned in the foregoing patent publications, alone), is heated and mixed, as shown below, the metallic soap and un-neutralized acid groups present on the ionomer undergo exchange reactions, generating a fatty acid. The fatty acid has a low thermal stability and readily vaporizes during molding, thus causing molding defects. Moreover, in cases where the fatty acid thus generated deposits on the surface of the molded material, it substantially lowers paint film adhesion.

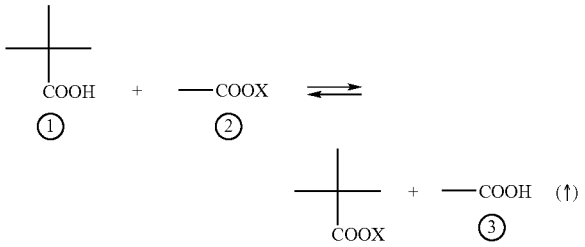

(1) un-neutralized acid group present on the ionomer resin
(2) metallic soap
(3) fatty acid
X: metal atom To solve this problem, the resin composition includes, as component (c), a basic inorganic metal compound which neutralizes the acid groups present in above components (a) and/or (d) and component (b). The inclusion of component (c) as an essential ingredient confers excellent properties. That is, the acid groups in above components (a) and/or (d) and component (b) are neutralized, and synergistic effects from the inclusion of each of these respective components increase the thermal stability of the resin composition while at the same time conferring a good moldability and enhancing the resilience as a golf ball material.

It is recommended that above component (c) be a basic inorganic metal compound, preferably a monoxide, which is capable of neutralizing acid groups in above components (a) and/or (d) and in component (b). Because such compounds have a high reactivity with the ionomer resin and the reaction by-products contain no organic matter, the degree of neutralization of the resin composition can be increased without a loss of thermal stability.

The metal ions used here in the basic inorganic metal compound are exemplified by $Li^{+}$, $Na^{+}$, $K^{+}$, $Ca^{++}$, $Mg^{++}$, $Zn^{++}$, $Al^{+++}$, $Ni^{+}$, $Fe^{++}$, $Fe^{+++}$, $Cu^{++}$, $Mn^{++}$, $Sn^{++}$, $Pb^{++}$ and $Co^{++}$. Illustrative examples of the inorganic metal compound include basic inorganic fillers containing these metal ions, such as magnesium oxide, magnesium hydroxide, magnesium carbonate, zinc oxide, sodium hydroxide, sodium carbonate, calcium oxide, calcium hydroxide, lithium hydroxide and lithium carbonate. As noted above, a monoxide is preferred. The use of magnesium oxide, which has a high reactivity with ionomer resins, is especially preferred.

The resin composition which includes, as described above, components (a), (d), (b) and (c) can be provided with an improved thermal stability, moldability and resilience. To achieve these ends, the components must be formulated in certain proportions. Specifically, it is essential to include, per 100 parts by weight of component (a) and/or component (d) (referred to below as the "base resin"), at least 5 parts by weight, but not more than 80 parts by weight, preferably not more than 40 parts by weight, and more preferably not more than 20 parts by weight, of component (b); and at least 0.1 part by weight, but not more than 10 parts by weight, and preferably not more than 5 parts by weight, of component (c). Too little component (b) lowers the melt viscosity, resulting in a poor processability, whereas too much lowers the durability. Too little component (c) fails to improve thermal stability and resilience, whereas too much instead lowers the heat resistance of the composition due to the presence of excess basic inorganic metal compound.

The above-described material may be used directly as the resin composition, or other ingredients may also be suitably included in the mixture. In either case, it is critical for the resin composition to have a melt index, as measured according to JIS K6760 at a test temperature of 190° C. and a test load of 21 N (2.16 kgf), of at least 1.0 dg/min, preferably at least 1.5 dg/min, and more preferably at least 2.0 dg/min. It is recommended that the upper limit in the test load be preferably not more than 20 dg/min, and more preferably not more than 15 dg/min. However, if the resin composition has a low melt index, the result will be a marked decline in processability.

It is preferable for the resin composition to have, in infrared absorption spectroscopy, a specific relative absorbance at the absorption peak attributable to carboxylate anion stretching vibrations at 1530 to 1630 $cm^{-1}$ with respect to the absorbance at the absorption peak attributable to carbonyl stretching vibrations normally detected at 1690 to 1710 $cm^{-1}$. This ratio may be expressed as follows: (absorbance at absorption peak attributable to carboxylate anion stretching vibrations)/(absorbance at absorption peak attributable to carbonyl stretching vibrations).

Here, "carboxylate anion stretching vibrations" refers to vibrations by carboxyl groups from which the proton has dissociated (metal ion-neutralized carboxyl groups), and "carbonyl stretching vibrations" refers to vibrations by undissociated carboxyl groups. The ratio between these respective peak intensities depends on the degree of neutralization. In the ionomer resins having a degree of neutralization of about 50 mol % which are commonly used, the ratio between these peak absorbances is about 1:1.

To improve the thermal stability, moldability and resilience of the material, it is recommended that the above resin composition have a peak absorbance attributable to carboxylate anion stretching vibrations which is preferably at least 1.5 times, and more preferably at least 2 times, the peak absorbance attributable to carbonyl stretching vibrations. The absence of any peaks attributable to carbonyl stretching vibrations is especially preferred.

The thermal stability of the above resin composition can be measured by thermogravimetry. It is recommended that, in thermogravimetry, the resin composition have a weight loss at 250° C., based on the weight of the mixture at 25° C., of preferably not more than 2 wt %, more preferably not more than 1.5 wt %, and even more preferably not more than 1 wt t.

It is recommended that the specific gravity of the resin composition proper, while not subject to any particular limitation, be preferably at least 0.9, but preferably not more than 1.5, more preferably not more than 1.3, and even more preferably not more than 1.1.

The resin composition is obtained by heating and mixing the above-described component (a) and/or component (d), with component (b) and component (c), and has an optimized melt index. It is recommended that preferably at least 70 mol %, more preferably at least 80 mol %, and even more preferably at least 90 mol %, of the acid groups in the resin composition be neutralized. A high degree of neutralization makes it possible to more reliably suppress the exchange reactions that are a problem when only the above-described base resin and the fatty acid (or a derivative thereof) are used, thus preventing the formation of fatty acids. As a result, there can be obtained a material which has a greatly increased thermal stability and a good moldability, and which moreover has a much improved resilience compared with conventional ionomer resins.

Here, with regard to neutralization of the resin composition, to more reliably achieve both a high degree of neutralization and good flow properties, it is recommended that the acid groups in the resin composition be neutralized with transition metal ions and with alkali metal and/or alkaline earth metal ions. Because transition metal ions have a weaker ionic cohesion than alkali metal and alkaline earth metal ions, it is possible in this way to neutralize some of the acid groups in the resin composition and thus enable the flow properties to be significantly improved.

The molar ratio between the transition metal ions and the alkali metal and/or alkaline earth metal ions is set as appropriate, preferably in a range of 10:90 to 90:10, and more preferably from 20:80 to 80:20. Too low a molar ratio of transition metal ions may fail to provide sufficient improvement in the flow properties of the resin composition. On the other hand, a molar ratio that is too high may lower the resilience.

Specific examples of such metal ions include zinc ions as the transition metal ions and at least one type of ion selected from among sodium, lithium, magnesium and calcium ions as the alkali metal or alkaline earth metal ions.

No particular limitation is imposed on the method used to obtain the resin composition in which the acid groups have been neutralized with transition metal ions and alkali metal or alkaline earth metal ions. Specific examples of methods of neutralization with transition metal ions, particularly zinc ions, include a method involving the use of a zinc soap as the fatty acid derivative, a method in which a zinc ion neutralization product is included as component (d) in the base resin (e.g., a zinc-neutralized ionomer resin), and a method in which zinc oxide is used as the basic inorganic metal compound serving as component (c).

As already noted, to obtain the inner cover layer, it suffices to use the above resin composition as the essential ingredients, although various additives may be optionally included as well. For example, additives such as pigments, dispersants, antioxidants, ultraviolet absorbers and optical stabilizers may be included within the above resin composition. To improve the feel of the golf ball on impact, the resin composition may also include, in addition to the above essential ingredients, various non-ionomeric thermoplastic elastomers. Illustrative examples of such non-ionomeric thermoplastic elastomers include olefin elastomers, styrene elastomers, ester elastomers and urethane elastomers. The use of olefin elastomers and styrene elastomers is especially preferred.

The following may also be added to the inner cover layer:

(e) a thermoplastic elastomer selected from the group consisting of thermoplastic polyester elastomers, thermoplastic block copolymers and thermoplastic urethanes, (f) a thermoplastic block copolymer containing end blocks modified by a functional group having reactivity with an ionomer resin, both end blocks being formed of different comonomers, and (g) an inorganic filler which is non-reactive with an ionomer resin.

Component (e)

Thermoplastic polyester elastomers that may be used as component (e) are composed primarily of hard segments which are high-melting crystalline polymers made up of crystalline aromatic polyester units, and soft segments which are low-melting polymers made up of aliphatic polyether units and/or aliphatic polyester units.

Preferred examples of the high-melting crystalline polymers include polybutylene terephthalates derived from terephthalic acid and/or dimethyl terephthalate in combination with 1,4-butanediol. Other illustrative examples include polyesters derived from a dicarboxylic acid component such as isophthalic acid, phthalic acid, naphthalene-2,6-dicarboxylic acid, naphthalene-2,7-dicarboxylic acid, diphenyl-4,4'-dicarboxylic acid, diphenoxyethanedicarboxylic acid, 5-sulfoisophthalic acid or ester-forming derivatives thereof in combination with a diol having a molecular weight of up to 300, such as an aliphatic diol (e.g., ethylene glycol, trimethylene glycol, pentamethylene glycol, hexamethylene glycol, neopentyl glycol, decamethylene glycol), an alicyclic diol (e.g., 1,4-cyclohexanedimethanol, tricyclodecanedimethylol), or an aromatic diol (e.g., xylylene glycol, bis(p-hydroxy)diphenyl, bis(p-hydroxyphenyl)propane, 2,2-bis[4-(2-hydroxyethoxy)phenyl]propane, bis[4-(2-hydroxy)phenyl]sulfone, 1,1-bis[4-(2-hydroxyethoxy)phenyl]cyclohexane, 4,4'-dihydroxy-p-terphenyl, 4,4'-dihydroxy-p-quarterphenyl). Use can also be made of copolymeric polyesters prepared from two or more of these dicarboxylic acid components and diol components. In addition, polycarboxylic acid components, polyoxy acid components and polyhydroxy components having a functionality of three or more may be copolymerized in component (e) within a range of up to 5 mol %.

The low-melting polymers are composed of aliphatic polyether units and/or aliphatic polyester units.

Illustrative examples of aliphatic polyether units include poly(ethylene oxide) glycol, poly(propylene oxide) glycol, poly(tetramethylene oxide) glycol, poly(hexamethylene oxide) glycol, copolymers of ethylene oxide and propylene oxide, ethylene oxide addition polymers of poly(propylene oxide) glycols, and copolymers of ethylene oxide and tetrahydrofuran. Illustrative examples of aliphatic polyester units include poly(ε-caprolactone), polyenantholactone, polycaprylolactone, poly(butylene adipate) and poly(ethylene adipate). Of the above polymers, in terms of the resilience characteristics of the resulting polyester block copolymer, poly(tetramethylene oxide) glycol, ethylene oxide addition polymers of poly(propylene oxide) glycol, poly(ε-caprolactone), poly(butylene adipate) and poly(ethylene adipate) are preferred. Poly(tetramethylene oxide) glycol is especially preferred.

The low-melting polymer segments have a number-average molecular weight in the copolymerized state of preferably about 300 to about 6,000.

Letting the combined amount of high-melting crystalline polymer segments and low-melting polymer segments which are copolymerized to form the thermoplastic polyester elastomer be 100 wt %, it is advantageous for the thermoplastic polyester elastomer to include at least 15 wt %, and preferably at least 50 wt %, but not more than 90 wt %, of the low-melting polymer segments. At a proportion of low-melting polymer segments that is higher than the above range, adequate melt characteristics suitable for injection molding may not be attainable, which can make it difficult to achieve uniform mixture during melt blending with the other components. On the other hand, if the proportion is too low, sufficient flexibility and resilience may not be achieved.

The above-described thermoplastic polyester elastomer is a copolymer composed primarily of the foregoing high-melting crystalline polymer segments and low-melting polymer segments. The thermoplastic polyester elastomer may be prepared by a known method without particular limitation. Exemplary methods of preparation include methods (i) to (v) below, any of which may be suitably used.

(i) A method in which a lower alcohol diester of a dicarboxylic acid, an excess amount of low-molecular-weight glycol, and the low-melting polymer segment component are subjected to transesterification in the presence of a catalyst, and the resulting reaction products are polycondensed.

(ii) A method in which a dicarboxylic acid, an excess amount of a glycol and the low-melting polymer segment component are subjected to esterification in the presence of a catalyst, and the resulting reaction products are polycondensed.

(iii) A method in which first the high-melting crystalline segments are prepared, then the low-melting segments are added thereto and a transesterification reaction is carried out to effect randomization.

(iv) A method in which the high-melting crystalline segments and the low-melting polymer segments are joined together using a chain linking agent.

(v) In cases where poly(ϵ-caprolactone) is used as the low-melting polymer segments, a method in which the high-melting crystalline segments are subjected to an addition reaction with ϵ-caprolactone monomer.

It is recommended that the above-described thermoplastic polyester elastomer have a hardness, as measured in accordance with ASTM D-2240 (Shore D hardness), of preferably at least 10, and more preferably at least 20, but preferably not more than 50, and more preferably not more than 40.

Moreover, it is advantageous for the above thermoplastic polyester elastomer to exhibit a high rebound resilience, as measured in accordance with British Standard 903 (BS 903), of preferably at least 40%, and more preferably at least 50%, but preferably not more than 90%. If the rebound resilience is too low, moldings obtained from the resin composition of the invention will have a low resilience, which may diminish the flight performance of golf balls made with such moldings.

It is desirable for the above thermoplastic polyester elastomer to have a flexural rigidity, as measured in accordance with JIS K-7106, which is relatively low, with a value of preferably at least 5 MPa, more preferably at least 10 MPa, and even more preferably at least 15 MPa, but preferably not more than 250 MPa, more preferably not more than 200 MPa, and even more preferably not more than 150 MPa. If the flexural rigidity is too high, moldings obtained from the resin composition of the invention will be too rigid, which may worsen the feel and durability of golf balls made with such moldings.

Thermoplastic block copolymers that may be used as component (e) include those in which the hard segments are made of crystalline polyethylene blocks (C) and/or crystalline polystyrene blocks (S), and the soft segments are made of polybutadiene blocks (B), polyisoprene blocks (I), blocks of a relatively random copolymer of ethylene and butylene (EB) or blocks of a relatively random copolymer of ethylene and propylene (EP). Blocks of a relatively random copolymer of ethylene and butylene (EB), and blocks of a relatively random copolymer of ethylene and propylene (EP) are preferred as the soft segments. Blocks of a relatively random copolymer of ethylene and butylene (EB) are especially preferred as the soft segments.

Illustrative examples of such thermoplastic block copolymers include S-EB-S, S-B-S, S-I-S, S-EB, S-EB-S-EB, S-EP-S, S-EB-C, S-B-C, S-I-C, S-EP-C, C-EB-C, C-B-C, C-I-C, C-EB, C-EB-C-EB and C-EP-C. Including crystalline polyethylene blocks (C) as the hard segments is advantageous from the standpoint of resilience. The use of S-EP-C is preferred, and the use of C-EB-C is especially preferred.

If the thermoplastic block copolymer is a C-EB-C or S-EB-C type block copolymer, this may be obtained by hydrogenating butadiene or a styrene-butadiene copolymer.

A polybutadiene in which bonding within the butadiene structure is characterized by the presence of block-like 1,4-polymer regions having a 1,4-bond content of at least 95 wt %, and in which the butadiene structure as a whole has a 1,4-bond content of at least 50 wt %, and preferably at least 80 wt %, may be suitably used here as the polybutadiene or styrene-butadiene copolymer subjected to hydrogenation.

The degree of hydrogenation (conversion of double bonds in the polybutadiene or styrene-butadiene copolymer to saturated bonds) in the hydrogenate is preferably from 60 to 100%, and more preferably from 90 to 100%. Too low a degree of hydrogenation may give rise to undesirable effects such as gelation in the blending step with other components such as an ionomer resin and, when the golf ball is formed, may compromise the weather resistance of the cover and the durability of the ball to impact.

In the thermoplastic block copolymer, the content of the hard segments is preferably from 10 to 50 wt %. If the content of hard segments is too high, the inner cover layer may lack sufficient softness, making it difficult to effectively achieve the objects of the invention. On the other hand, if the content of hard segments is too low, the blend may have a poor moldability.

The thermoplastic block copolymer has a number-average molecular weight of preferably from 30,000 to 800,000. The thermoplastic block copolymer has a melt index at 230° C. of preferably from 0.5 to 15 g/10 min, and more preferably from 1 to 7 g/10 min. Outside of this range, problems such as weld lines, sink marks and short shots may arise during injection molding.

Thermoplastic polyurethane elastomers that may be used as component (e) preferably have a morphology composed of, in particular, a high-molecular-weight polyol compound making up the soft segments, a monomolecular chain extender making up the hard segments, and a diisocyanate.

The high-molecular-weight polyol compound is not subject to any particular limitation and may be, for example, a polyester polyol, a polyol polyol, a polyether polyol, a copolyester polyol or a polycarbonate polyol. Exemplary polyester polyols include polycaprolactone glycol, poly(ethylene-1,4-adipate) glycol and poly(butylene-1,4-adipate) glycol; exemplary copolyester polyols include poly(diethylene glycol adipate) glycol; exemplary polycarbonate polyols include (hexanediol-1,6-carbonate) glycol; and exemplary polyether polyols include polyoxytetramethylene glycol.

These high-molecular-weight polyol compounds have a number-average molecular weight of from about 600 to about 5,000, and preferably from about 1,000 to about 3,000.

The aliphatic or aromatic diisocyanate in the cover may be suitably used as the diisocyanate. Illustrative examples include hexamethylene diisocyanate (HDI), 2,2,4- and 2,4,4-trimethylhexamethylene diisocyanate (TMDI), lysine diisocyanate (LDI), tolylene diisocyanate (TDI) and diphenylmethane diisocyanate (MDI). For a good compatibility when blending with other resins, the use of hexamethylene diisocyanate (HDI) or diphenylmethane diisocyanate (MDI) is preferred.

The monomolecular chain extender, which is not subject to any particular limitation, may be an ordinary polyhydric alcohol or polyamine. Specific examples include 1,4-butylene glycol, 1,2-ethylene glycol, 1,3-propylene glycol, 1,6-hexylene glycol, 1,3-butylene glycol, dicyclohexylmethylmethanediamine (hydrogenated MDI) and isophoronediamine (IPDA).

The above thermoplastic polyurethane elastomer has a JIS-A hardness of preferably at least 70, more preferably at least 80, even more preferably at least 90, and most preferably at least 95, but preferably not more than 100, more preferably not more than 99, and even more preferably not more than 98. At a JIS-A hardness below 70, the ball may take on excessive spin when hit with a driver, resulting in a shorter distance. No particular limitation is imposed on the specific gravity of the thermoplastic polyurethane elastomer, so long as it is suitably adjusted within a range where the objects of the invention are attainable. The specific gravity is preferably between 1.0 and 1.3, and more preferably between 1.1 and 1.25.

A commercial product may be used as the above-described thermoplastic polyurethane elastomer. Illustrative examples include Pandex TR3080, Pandex T7298, Pandex EX7895, Pandex T7890 and Pandex T8198 (all manufactured by DIC Bayer Polymer, Ltd.).

Component (f)

Next, the thermoplastic block copolymer which contains end blocks modified by a functional group having reactivity with an ionomer resin, wherein both end blocks are formed of different comonomers, and serves as component (f) is described.

The thermoplastic block copolymer serving as the base of component (f) is exemplified by block copolymers of the following types: $H_1$-$S_1$, $H_1$-$S_1$-$H_1$-$S_1$, $H_1$-$(S_1$-$H_1)_n$-$S_1$ and $H_1$-$S_1$-$H_2$ (wherein $H_1$ and $H_2$ are hard segments, and $S_1$ is a soft segment). In particular, the use of an $H_1$-$S_1$ type di-block copolymer or an $H_1$-$S_1$-$H_2$ type tri-block copolymer is preferred. The use of an $H_1$-$S_1$-$H_2$ type tri-block copolymer is more preferred. Compared with the use of other block copolymers, graft copolymers and random copolymers, the compatibility can be markedly improved.

Hard segments that may be used in component (f) are exemplified by crystalline olefin blocks, aromatic vinyl compound blocks, polyester blocks and polyamide blocks. In particular, effective improvement in the compatibility is achieved with the use of preferably crystalline olefin blocks, aromatic vinyl compound blocks or polyester blocks, and more preferably crystalline olefin blocks or aromatic vinyl compound blocks. Crystalline olefin blocks are exemplified by crystalline ethylene blocks (C) and crystalline propylene blocks. The use of crystalline ethylene blocks is especially preferred. Preferred use may be made of styrene blocks (S) as the aromatic vinyl compound blocks, of polytetramethylene terephthalate blocks (PBT) as the polyester blocks, and of nylon blocks as the polyamide blocks.

Soft segments that may be used include polybutadiene blocks (B), polyisoprene blocks (I), blocks of relatively random copolymers of ethylene and butylene (EB), and blocks of relatively random copolymers of ethylene and propylene (EP). The use of blocks of relatively random copolymers of ethylene and butylene (EB) or blocks of relatively random copolymers of ethylene and propylene (EP) is preferred. Blocks of relatively random copolymers of ethylene and butylene (EB) are especially preferred.

As noted above, in the thermoplastic block copolymer used as component (f), the blocks at either end of the copolymer are formed of different comonomers. Illustrative examples of such thermoplastic block copolymers include S-EB-C, S-B-C, S-I-C, S-EB, S-EB-S-EB, S-EP-C, PBT-S-EB and PBT-S-EB-C. To more effectively improve the compatibility of the ionomer resin and the thermoplastic elastomer, it is preferable to use S-EB-C or PBT-S-EB, and more preferable to use S-EB-C.

If the thermoplastic block copolymer is an S-EB-C type block copolymer, it can be obtained by hydrogenating a styrene-butadiene copolymer.

A polybutadiene in which bonding within the butadiene structure is characterized by the presence of block-like 1,4-polymer regions having a 1,4-bond content of at least 95 wt %, and in which the butadiene structure as a whole has a 1,4-bond content of at least 50 wt %, and preferably at least 80 wt %, may be suitably used here as the polybutadiene or styrene-butadiene copolymer in hydrogenation.

The degree of hydrogenation (conversion of double bonds in the polybutadiene or styrene-butadiene copolymer to saturated bonds) in the hydrogenate of the styrene-butadiene copolymer is preferably at least 60%, and more preferably at least 90%, with an upper limit of preferably 100%. Too low a degree of hydrogenation may give rise to undesirable effects such as gelation in the blending step with other components such as an ionomer resin and, when the golf ball is formed, may compromise the weather resistance of the cover and the durability of the ball to impact.

In the above block copolymer having crystalline olefin blocks, the content of the hard segments is preferably from 10 to 50 wt %. If the content of hard segments is too high, the inner cover layer may lack sufficient softness, making it difficult to effectively achieve the objects of the invention. On the other hand, if the content of hard segments is too low, the resulting blend may have a poor moldability.

The block copolymer having such crystalline olefin blocks has a number-average molecular weight of preferably from 30,000 to 800,000.

In the practice of the invention, only the end blocks on the thermoplastic block copolymer are modified with functional groups. The compatibility can be very effectively improved in this way compared with when only intermediate blocks are modified, when both intermediate blocks and end blocks are modified, or when modification is carried out along the entire molecule, as in random copolymers.

The end block modifying method is preferably a method in which only the ends of the molecule are modified. This has the advantage that more functional groups than necessary do not react with the ionomer resin and increase the viscosity of the mixture. Moreover, the compatibility can be very effectively improved because the molecular ends of the block copolymer bond with the ionomer resin.

If the functional groups which react with the ionomer resin have too high a reactivity, the viscosity will decrease, whereas a reactivity which is too low will lower the compatibility-improving effect. Hence, it is preferable for the functional groups to have a moderate degree of reactivity. Examples of such functional groups that may be used include, in order of preference, amino groups, acid anhydride groups, and epoxy groups. Amino groups are especially preferred.

The thermoplastic block copolymer has a melt index at 230° C. of preferably from 0.5 to 15 g/10 min, and more preferably from 1 to 7 g/10 min. Outside of this range, problems such as weld lines, sink marks and short shots may arise during injection molding.

The above components are compounded in a weight ratio of (base resin a+d)/e/f of 50 to 80/50 to 20/4 to 20. In this ratio, the amount of component (a) is preferably at least 60%, more preferably at least 65%, and even more preferably at least 70%, but preferably not more than 75%. The amount of component (e) is preferably at least 23%, and more preferably at least 25%, but preferably not more than 40%, and more preferably not more than 30%. The amount of component (f) is preferably at least 5%, but preferably not more than 15%, more preferably not more than 10%, and even more preferably not more than 7%. Outside of these ranges, resilience cannot be achieved and the compatibility worsens, as a result of which laminar separation may arise.

Component (g)

In addition, an inorganic filler which is non-reactive with ionomer resins may also be added in an amount of from 10 to 30 parts by weight per 100 parts by weight of the base polymer.

In such a case, to effectively improve the durability of the cover composition, it is advantageous for the average particle size of the inorganic filler to be preferably at least 0.01 μm, more preferably at least 0.05 μm, and even more preferably at least 0.1 μm, but preferably not more than 5 μm, more preferably not more than 3 μm, and even more preferably not more than 1 μm.

To adjust the specific gravity of the cover composition, the specific gravity of the inorganic filler is preferably at least 2, and more preferably at least 4, but preferably not more than 7, and more preferably not more than 5.

Whether the inorganic filler is indeed "non-reactive with ionomer resins" is verified by the absence of foaming and a large rise in viscosity when the inorganic filler is melt-mixed with an ionomer resin. For example, when inorganic filler in an amount such as may be used in the invention is added to the typical ionomer resin available under the trade name "Himilan 1605" and mixed therewith at 200° C. for 5 minutes, if foaming does not arise and the melt index after mixing is 1 or more, the inorganic filler may be regarded as having no reactivity with the ionomer resin.

Examples of such inorganic fillers include barium sulfate, titanium dioxide and hard clay. Barium sulfate is especially preferred. The use of precipitated barium sulfate is preferred because of its particle size stability.

Outer Cover Layer Material

The outer cover layer is made of a molded resin blend consisting primarily of (A) a thermoplastic polyurethane and (B) a polyisocyanate compound. The resin blend has present therein a polyisocyanate compound within at least some portion of which all the isocyanate groups on the molecule remain in an unreacted state. Golf balls made with such a thermoplastic polyurethane have an excellent rebound, spin performance and scuff resistance.

The outer cover layer is composed mainly of a thermoplastic polyurethane, and is formed of a resin blend of primarily (A) a thermoplastic polyurethane and (B) a polyisocyanate compound.

To fully exhibit the advantageous effects of the invention, a necessary and sufficient amount of unreacted isocyanate groups should be present in the outer cover layer-forming resin material. Specifically, it is recommended that the combined weight of above components A and B together be at least 60%, and preferably at least 70%, of the overall weight of the outer cover layer. Components A and B are described in detail below.

The thermoplastic polyurethane serving as component A has a structure which includes soft segments made of a polymeric polyol (polymeric glycol) that is a long-chain polyol, and hard segments made of a chain extender and a polyisocyanate compound. Here, the long-chain polyol used as a starting material is not subject to any particular limitation, and may be any that is used in the prior art relating to thermoplastic polyurethanes. Exemplary long-chain polyols include polyester polyols, polyether polyols, polycarbonate polyols, polyester polycarbonate polyols, polyolefin polyols, conjugated diene polymer-based polyols, castor oil-based polyols, silicone-based polyols and vinyl polymer-based polyols. These long-chain polyols may be used singly or as combinations of two or more thereof. Of the long-chain polyols mentioned here, polyether polyols are preferred because they enable the synthesis of thermoplastic polyurethanes having a high rebound resilience and excellent low-temperature properties.

Illustrative examples of the above polyether polyol include poly(ethylene glycol), poly(propylene glycol), poly(tetramethylene glycol) and poly(methyltetramethylene glycol) obtained by the ring-opening polymerization of a cyclic ether. The polyether polyol may be used singly or as a combination of two or more thereof. Of these, poly(tetramethylene glycol) and/or poly(methyltetramethylene glycol) are preferred.

It is preferable for these long-chain polyols to have a number-average molecular weight in a range of 1,500 to 5,000. By using a long-chain polyol having a number-average molecular weight within this range, golf balls made of a thermoplastic polyurethane composition having excellent properties such as resilience and manufacturability can be reliably obtained. The number-average molecular weight of the long-chain polyol is more preferably in a range of 1,700 to 4,000, and even more preferably in a range of 1,900 to 3,000.

As used herein, "number-average molecular weight of the long-chain polyol" refers to the number-average molecular weight computed based on the hydroxyl number measured in accordance with JIS K-1557.

Suitable chain extenders include those used in the prior art relating to thermoplastic polyurethanes. For example, low-molecular-weight compounds which have a molecular weight of 400 or less and bear on the molecule two or more active hydrogen atoms capable of reacting with isocyanate groups are preferred. Illustrative, non-limiting, examples of the chain extender include 1,4-butylene glycol, 1,2-ethylene glycol, 1,3-butanediol, 1,6-hexanediol and 2,2-dimethyl-1,3-propanediol. Of these chain extenders, aliphatic diols having 2 to 12 carbons are preferred, and 1,4-butylene glycol is especially preferred.

The polyisocyanate compound is not subject to any particular limitation, although use may be made of one that is used in the prior art relating to thermoplastic polyurethanes. Specific examples include one or more selected from the group consisting of 4,4'-diphenylmethane diisocyanate, 2,4-toluene diisocyanate, 2,6-toluene diisocyanate, p-phenylene diisocyanate, xylylene diisocyanate, naphthylene-1,5-diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethylhexamethylene diisocyanate and dimer acid diisocyanate. Depending on the type of isocyanate used, the crosslinking reaction during injection molding may be difficult to control. In the practice of the invention, to provide a balance between stability at the time of production and the properties that are manifested, it is most preferable to use 4,4'-diphenylmethane diisocyanate, which is an aromatic diisocyanate.

It is most preferable for the thermoplastic polyurethane serving as above component A to be a thermoplastic polyurethane synthesized using a polyether polyol as the long-chain polyol, using an aliphatic diol as the chain extender, and using an aromatic diisocyanate as the polyisocyanate compound. It is desirable, though not essential, for the polyether polyol to be a polytetramethylene glycol having a number-average molecular weight of at least 1,900, for the chain extender to be 1,4-butylene glycol, and for the aromatic diisocyanate to be 4,4'-diphenylmethane diisocyanate.

The mixing ratio of activated hydrogen atoms to isocyanate groups in the above polyurethane-forming reaction can be adjusted within a desirable range so as to make it possible to obtain a golf ball which is composed of a thermoplastic polyurethane composition and has various improved properties, such as rebound, spin performance, scuff resistance and manufacturability. Specifically, in preparing a thermoplastic polyurethane by reacting the above long-chain polyol, polyisocyanate compound and chain extender, it is desirable to use the respective components in proportions such that the amount of isocyanate groups on the polyisocyanate compound per mole of active hydrogen atoms on the long-chain polyol and the chain extender is from 0.95 to 1.05 moles.

No particular limitation is imposed on the method of preparing the thermoplastic polyurethane used as component A. Production may be carried out by either a prepolymer process or one-shot process in which the long-chain polyol, chain extender and polyisocyanate compound are used and a known urethane-forming reaction is effected. Of these, a process in which melt polymerization is carried out in a substantially solvent-free state is preferred. Production by continuous melt polymerization using a multiple screw extruder is especially preferred.

Illustrative examples of the thermoplastic polyurethane serving as component A include commercial products such as Pandex T8295, Pandex T8290 and Pandex T8260 (all available from DIC Bayer Polymer, Ltd.).

Next, concerning the polyisocyanate compound used as component B, it is critical that, in at least some portion of the polyisocyanate compound in the single resin blend, all the isocyanate groups on the molecule remain in an unreacted state. That is, polyisocyanate compound in which all the isocyanate groups on the molecule are in a completely free state must be present within the single resin blend, and such a polyisocyanate compound may be present together with polyisocyanate compound in which some of the isocyanate groups on the molecule are in a free state.

Various types of isocyanates may be employed without particular limitation as the polyisocyanate compound. Illustrative examples include one or more selected from the group consisting of 4,4'-diphenylmethane diisocyanate, 2,4-toluene diisocyanate, 2,6-toluene diisocyanate, p-phenylene diisocyanate, xylylene diisocyanate, naphthylene-1,5-diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethylhexamethylene diisocyanate and dimer acid diisocyanate. Of the above group of isocyanates, the use of 4,4'-diphenylmethane diisocyanate, dicyclohexylmethane diisocyanate and isophorone diisocyanate is preferable for achieving a good balance between the influence on processability of such effects as the rise in viscosity that accompanies the reaction with the thermoplastic polyurethane serving as component A and the physical properties of the resulting golf ball cover material.

In the practice of the invention, although not an essential constituent, a thermoplastic elastomer other than the above-described thermoplastic polyurethane may be included as component C together with components A and B. Including this component C in the above resin blend enables the flow properties of the resin blend to be further improved and enables properties required of golf ball cover materials, such as resilience and scuff resistance, to be increased.

Component C, which is a thermoplastic elastomer other than the above thermoplastic polyurethane, is exemplified by one or more thermoplastic elastomer selected from among polyester elastomers, polyamide elastomers, ionomer resins, styrene block elastomers, hydrogenated styrene-butadiene rubbers, styrene-ethylene/butylene-ethylene block copolymers and modified forms thereof, ethylene-ethylene/butylene-ethylene block copolymers and modified forms thereof, styrene-ethylene/butylene-styrene block copolymers and modified forms thereof, ABS resins, polyacetals, polyethylenes and nylon resins. The use of polyester elastomers, polyamide elastomers and polyacetals is especially preferred because, owing to reactions with isocyanate groups, the resilience and scuff resistance are enhanced while at the same time a good manufacturability is retained.

The relative proportions of above components A, B and C are not subject to any particular limitation, although to fully achieve the advantageous effects of the invention, it is preferable for the weight ratio A:B:C of the respective components to be from 100:2:50 to 100:50:0, and more preferably from 100:2:50 to 100:30:8.

In the practice of the invention, the resin blend is prepared by mixing component A with component B, and additionally mixing in also component C. It is critical to select the mixing conditions such that, of the polyisocyanate compound, at least some polyisocyanate compound is present in which all the isocyanate groups on the molecule remain in an unreacted state. For example, treatment such as mixture in an inert gas (e.g., nitrogen) or in a vacuum state must be furnished. The resin blend is then injection-molded around a core which has been placed in a mold. To smoothly and easily handle the resin blend, it is preferable for the blend to be formed into pellets having a length of 1 to 10 mm and a diameter of 0.5 to 5 mm. Isocyanate groups in an unreacted state remain within these resin pellets; while the resin blend is being injection-molded about the core, or due to post-treatment such as annealing thereafter, the unreacted isocyanate groups react with component A or component C to form a crosslinked material.

The above method of molding the cover layer is exemplified by feeding the above-described resin blend to an injection molding machine, and injecting the molten resin blend around the core so as to form a cover layer. The molding temperature varies according to such factors as the type of thermoplastic polyurethane, but is typically in a range of 150 to 250° C.

When injection molding is carried out, it is desirable though not essential to carry out molding in a low-humidity environment, such as by purging with a low-temperature gas using an inert gas such as nitrogen or low dew-point dry air, or vacuum-treating, some or all places on the resin paths from the resin feed area to the mold interior. Illustrative, non-limiting examples of the medium used for transporting the resin include low-moisture gases such as low dew-point dry air or nitrogen. By carrying out molding in such a low-humidity environment, reaction by the isocyanate groups is kept from proceeding before the resin has been charged into the mold interior. As a result, polyisocyanate in which the isocyanate groups are present in an unreacted state is included to some degree in the molded resin material, thus making it possible to reduce variable factors such as an unwanted rise in viscosity and enabling the effective crosslinking efficiency to be enhanced.

Techniques that could be used to confirm the presence of polyisocyanate compound in an unreacted state within the resin blend prior to injection molding about the core include those which involve extraction with a suitable solvent that selectively dissolves out only the polyisocyanate compound. An example of a simple and convenient method is one in which confirmation is carried out by simultaneous thermogravimetric and differential thermal analysis (TG-DTA) measurement in an inert atmosphere. For example, when the resin blend (cover material) used in the invention is heated in a nitrogen atmosphere at a temperature ramp-up rate of 10° C./min, a gradual drop in the weight of diphenylmethane diisocyanate can be observed from about 150° C. On the other hand, in a resin sample in which the reaction between the thermoplastic polyurethane material and the isocyanate mixture has been carried out to completion, a weight drop from about 150° C. is not observed, but a weight drop from about 230 to 240° C. can be observed.

After the resin blend has been molded as described above, its properties as a golf ball cover can be further improved by carrying out annealing so as to induce the crosslinking reaction to proceed further. "Annealing," as used herein, refers to aging the cover in a fixed environment for a fixed length of time.

In addition to the above resin components, various optional additives may be included in the outer cover layer material in the present invention. Such additives include, for example, pigments, dispersants, antioxidants, ultraviolet absorbers, ultraviolet stabilizers, parting agents, plasticizers, and inorganic fillers (e.g., zinc oxide, barium sulfate, titanium dioxide, tungsten).

When such additives are included, the amount of the additives is suitably selected from a range within which the objects of the invention are achievable, although it is preferable for such additives to be included in an amount, per 100 parts by weight of the thermoplastic polyurethane serving as an essential component of the invention, of preferably at least 0.1 part by weight, and more preferably at least 0.5 part by weight, but preferably not more than 10 parts by weight, and more preferably not more than 5 parts by weight.

Molding of the cover using the thermoplastic polyurethane of the invention may be carried out by using an injection-molding machine to mold the cover over the intermediate layer which encases the core. Molding is carried out at a molding temperature of generally from 150 to 250° C.

Next, the hardnesses of the respective cover layers are described.

In the present invention, the inner cover layer has a Shore D hardness of more than 58, preferably at least 59, and more preferably at least 60. The upper limit, while not subject to any particular limitation, is preferably not more than 65, more preferably not more than 64, and even more preferably not more than 63. At a Shore D hardness higher than the above range, the feel of the ball on impact may worsen. Also, the spin rate on approach shots may decrease, resulting in a poor controllability. Moreover, the spin rate of the ball on shots taken with a driver may become excessive, as a result of which the ball may assume a high trajectory and thus be more subject to wind effects.

The outer cover layer has a Shore D hardness of not more than 58, preferably not more than 57, and more preferably not more than 56. The lower limit, while not subject to any particular limitation, is preferably at least 35, more preferably at least 38, and even more preferably at least 46. At a Shore D hardness higher than the above range, the feel of the ball on impact may worsen, in addition to which the spin rate on approach shots may decrease, resulting in a poor controllability and thus making it impossible to achieve the objects of the invention. On the other hand, if the Shore D hard is too low, the ball may have an inferior rebound.

In the practice of the invention, the combined thickness of the cover layers (the sum of the respective thicknesses of the inner cover layer and the outer cover layer) must be at least 3.5, and is preferably at least 3.8 mm, and more preferably at least 4 mm. There is no particular upper limit in the combined thickness of the cover layers. If the combined thickness of the cover layer is less than the above range, the spin rate on shots taken with a driver will be excessive, as a result of which the ball may assume a high trajectory and thus be more subject to wind effects The inner cover layer has a thickness of preferably at least 2.8 mm, and more preferably at least 3 mm. There is no particular upper limit. At a thickness of less than 2.8 mm, the spin rate on shots with a driver may become excessive, as a result of which the ball may assume a high trajectory and may thus be more subject to wind effects.

The outer cover layer has a thickness of preferably at least 0.7 mm, and more preferably at least 0.8 mm, but preferably not more than 1.5 mm, and more preferably not more than 1.3 mm.

Dimples

The cover has a plurality of dimples on the surface thereof. The number of dimples is preferably at least 250, more preferably at least 280, and even more preferably at least 300, but preferably not more than 430, more preferably not more than 410, and even more preferably not more than 390. Within this range, the ball readily incurs lift forces, enabling the distance traveled by the ball, particularly on shots with a driver, to be increased. To better increase the surface coverage ratio of the dimples, it is recommended that the dimples be formed in preferably at least four types of mutually differing diameter and/or depth, more preferably at least five types, and even more preferably at least 6 types, but preferably not more than 20 types, more preferably not more than 15 types, and even more preferably not more than 12 types. The dimples are preferably formed so as to be circular as viewed from above, and have an average diameter of preferably at least 2.8 mm, more preferably at least 3.5 mm, and even more preferably at least 3.8 mm, but preferably not more than 5.0 mm, more preferably not more thane 4.6 mm, and even more preferably not more than 4.3 mm. To achieve an appropriate trajectory, it is desirable for the dimples to have an average depth of preferably at least 0.130 mm, more preferably at least 0.140 mm, and even more preferably at least 0.150 mm, but preferably not more than 0.185 mm, more preferably not more than 0.180 mm, and even more preferably not more than 0.174 mm. As used herein, "average diameter" refers to the mean value for the diameters of all the dimples, and "average depth" refers to the mean value for the depths of all the dimples. The diameter of a dimple is measured as the distance across the dimple between positions where the dimple region meets land (non-dimple) regions, that is, between the highest points of the dimple region. The golf ball is usually painted, in which case the dimple diameter refers to the diameter when the surface of the ball has been covered with paint. The depth of a dimple is measured by connecting together the positions where the dimple meets the surrounding land so as to define an imaginary flat plane, and determining the vertical distance from a center position on the flat plane to the bottom (deepest position) of the dimple.

As described above, in the three-piece solid golf ball of the invention, the ball rebound has been further improved and the spin rate on shots with a driver has been sufficiently reduced, thus increasing the distance traveled by the ball. In particular, on shots taken with a driver at high head speeds, the ball has a high initial velocity and thus travels farther.

EXAMPLES

The following Examples of the invention and Comparative Examples are provided by way of illustration and not by way of limitation.

Examples 1 to 3

Comparative Examples 1 to 4

Solid cores were produced by preparing core compositions of the formulations shown below in Table 1 (examples of invention) and Table 2 (comparative examples), then molding and vulcanizing the compositions under vulcanization conditions of 155° C. and 15 minutes. An inner cover layer was then injection-molded over each core using one of the cover compositions I, II and III shown in Table 3. Next, an outer cover layer was injection-molded over each of the resulting spheres from the cover composition IV shown in Table 3, thereby giving three-piece solid golf balls.

Injection of the cover composition IV in Table 3 was carried out as follows.

The various starting materials shown for cover composition IV (units: parts by weight) were kneaded in a nitrogen atmosphere with a twin-screw extruder to form a cover resin blend. This resin blend was in the form of pellets having a length of 3 mm and a diameter of 1 to 2 mm.

The above sphere was placed within an injection molding mold, and cover composition IV was injection-molded over the sphere, thereby forming in each example of the invention and each comparative example a three-piece golf ball having a 1.0 mm thick outer cover layer. To measure the cover properties, a 2 mm thick injection-molded sheet of the material was prepared, the sheet was subjected to 8 hours of annealing treatment at 100° C., then the annealed sheet was left to stand at room temperature for one week, following which the cover properties were measured.

TABLE 1

| | | Example | | |
|---|---|---|---|---|
| | | 1 | 2 | 3 |
| Core composition | 1,4-cis Polybutadiene | 100 | 100 | 100 |
| | 1,1-Bis(tert-butylperoxy)cyclohexane | 0.3 | 0.3 | 0.3 |
| | Dicumyl peroxide | 0.3 | 0.3 | 0.3 |
| | 2,2'-Methylenebis(4-methyl-6-t-butylphenol) | 0.1 | 0.1 | 0.1 |
| | Zinc diacrylate | 36 | 36 | 36 |
| | Zinc oxide | 5 | 5 | 5 |
| | Barium sulfate | 22.4 | 22.4 | 26.2 |
| | Zinc salt of pentachlorothiophenol | 1 | 1 | 1 |
| | Zinc stearate | 5 | 5 | 5 |
| Inner cover layer | Composition I | 100 | 100 | 100 |
| | Composition II | | | |
| | Composition III | | | |
| Outer cover layer | Composition IV | 100 | 100 | 100 |
| Core | Diameter (mm) | 34.9 | 34.5 | 33.9 |
| | Weight (g) | 27.0 | 26.2 | 25.2 |
| | Deflection (mm) | 2.8 | 2.8 | 2.9 |
| | Specific gravity | 1.22 | 1.22 | 1.24 |
| Inner cover layer | Thickness (mm) | 2.9 | 3.1 | 3.4 |
| | Hardness (Shore D) | 59 | 59 | 59 |
| | Specific gravity | 0.96 | 0.96 | 0.96 |
| | Outside diameter (mm) | 40.7 | 40.7 | 40.7 |
| | Weight (g) | 39.5 | 39.5 | 39.5 |
| Outer cover layer | Thickness (mm) | 1.0 | 1.0 | 1.0 |
| | Hardness (Shore D) | 54 | 54 | 54 |
| Ball | Diameter (mm) | 42.7 | 42.7 | 42.7 |
| | Weight (g) | 45.4 | 45.4 | 45.4 |
| | Deflection (mm) | 2.3 | 2.3 | 2.3 |
| | Number of dimples | 336 | 336 | 336 |
| | Average diameter of dimples (mm) | 4.0 | 4.0 | 4.0 |
| | Average depth of dimples (mm) | 0.161 | 0.161 | 0.161 |
| | Number of dimple types | 9 | 9 | 9 |
| | Initial velocity on shots with driver (m/s) | 80.8 | 80.7 | 80.6 |
| | Spin rate on shots with driver (rpm) | −20 | −31 | −38 |

TABLE 2

| | | Comparative Example | | | |
|---|---|---|---|---|---|
| | | 1 | 2 | 3 | 4 |
| Core composition | 1,4-cis Polybutadiene | 100 | 100 | 100 | 100 |
| | 1,1-Bis(tert-butylperoxy)cyclohexane | 0.3 | 0.3 | 0.3 | 0.3 |
| | Dicumyl peroxide | 0.3 | 0.3 | 0.3 | 0.3 |
| | 2,2'-Methylenebis(4-methyl-6-t-butylphenol) | 0.1 | 0.1 | 0.1 | 0.1 |
| | Zinc diacrylate | 36.5 | 32 | 36 | 36 |
| | Zinc oxide | 5 | 5 | 5 | 5 |
| | Barium sulfate | 11.0 | 24.0 | 22.4 | 22.4 |
| | Zinc salt of pentachlorothiophenol | 1 | 1 | 1 | 1 |
| | Zinc stearate | 5 | 5 | 5 | 5 |
| Inner cover layer | Composition I | 100 | 100 | | |
| | Composition II | | | 100 | |
| | Composition III | | | | 100 |
| Outer cover layer | Composition IV | 100 | 100 | 100 | 100 |
| Core | Diameter (mm) | 37.9 | 34.9 | 34.9 | 34.9 |
| | Weight (g) | 32.9 | 27.0 | 27.0 | 27.0 |
| | Deflection (mm) | 3 | 3.8 | 2.9 | 2.9 |
| | Specific gravity | 1.16 | 1.22 | 1.22 | 1.22 |
| Inner cover layer | Thickness (mm) | 1.4 | 2.9 | 2.9 | 2.9 |
| | Hardness (Shore D) | 59 | 59 | 53 | 61 |
| | Specific gravity | 0.96 | 0.96 | 0.96 | 0.96 |
| | Outside diameter (mm) | 40.7 | 40.7 | 40.7 | 40.7 |
| | Weight (g) | 39.5 | 39.5 | 39.5 | 39.5 |
| Outer cover layer | Thickness (mm) | 1.0 | 1.0 | 1.0 | 1.0 |
| | Hardness (Shore D) | 54 | 54 | 54 | 54 |
| Ball | Diameter (mm) | 42.7 | 42.7 | 42.7 | 42.7 |
| | Weight (g) | 45.4 | 45.4 | 45.4 | 45.4 |
| | Deflection (mm) | 2.4 | 3.0 | 2.3 | 2.3 |
| | Number of dimples | 336 | 336 | 336 | 336 |
| | Average diameter of dimples (mm) | 4.0 | 4.0 | 4.0 | 4.0 |
| | Average depth of dimples (mm) | 0.161 | 0.161 | 0.161 | 0.161 |
| | Number of dimple types | 9 | 9 | 9 | 9 |
| | Initial velocity on shots with driver (m/s) | 80.8 | 79.6 | 80.0 | 80.3 |
| | Spin rate on shots with driver (rpm) | 30 | −58 | 0 | −37 |

Details on the core materials are provided below. The numbers in the tables indicate parts by weight.

Polybutadiene: Produced by JSR Corporation under the trade name "BR730."

1,1-Bis(tert-butylperoxy)cyclohexane: Produced by NOF Corporation.

Dicumyl peroxide: 40% dilution produced by NOF Corporation.

2,2'-Methylenebis(4-methyl-6-t-butylphenol): Produced by Ouchi Shinko Chemical Industry Co., Ltd.

Zinc diacrylate: Produced by Nihon Jyoryu Kogyo Co., Ltd.

Zinc oxide: Produced by Sakai Chemical Industry Co., Ltd.

Barium sulfate: Produced by Sakai Chemical Industry Co., Ltd. under the trade name "Chinkosei Barium #100."

Zinc stearate: Produced by NOF Corporation.

TABLE 3

| Formulation | I | II | III | IV |
|---|---|---|---|---|
| Nucrel AN4213C | 100 | | | |
| Himilan 1605 | | 35 | 50 | |
| Himilan 1706 | | | 50 | |
| Surlyn 9945 | | 35 | | |
| Dynaron 6100P | | 30 | | |
| Polytail H | | | | 4 |
| Magnesium stearate | 20 | 0.31 | | |

TABLE 3-continued

| Formulation | I | II | III | IV |
|---|---|---|---|---|
| Calcium stearate | | 0.0018 | | |
| Zinc stearate | | 0.0018 | | |
| Magnesium oxide | 1.5 | | | |
| Trimethylolpropane | | 1 | | |
| Titanium dioxide | | 0.48 | | |
| Titanium yellow | | 0.005 | | |
| Phthalocyanine blue | | 0.003 | | |
| Carbon black | | 0.0003 | | |
| Pandex 8295 | | | | 25 |
| Pandex 8290 | | | | 75 |
| Thermoplastic polyether-ester elastomer | | | | 15 |
| Polyisocyanate compound | | | | 9 |

Note:
Numbers in the table indicate parts by weight.

Trade names for the principle materials appearing in the above table are given below.

Nucrel AN4213C: A ternary copolymer produced by DuPont-Mitsui Polychemicals Co., Ltd.

Himilan 1605: A zinc ionomer of a binary copolymer. Produced by DuPont-Mitsui Polychemicals Co., Ltd. Shore D hardness, 65.

Himilan 1706: A sodium ionomer of a binary copolymer. Produced by DuPont-Mitsui Polychemicals Co., Ltd. Shore D hardness, 64.

Surlyn 9945: A zinc ionomer of a binary copolymer. Produced by E.I. DuPont de Nemours & Co. Shore D hardness, 62.

Dynaron: An olefinic thermoplastic elastomer produced by JSR Corporation.

Polytail H: A low-molecular-weight polyolefin polyol produced by Mitsubishi Chemical Corporation.

Pandex: An MDI-PTMG type thermoplastic polyurethane produced by DIC-Bayer Polymer.

Titanium dioxide: Produced by Ishihara Sangyo Kaisha, Ltd. under the trade name "Tipaque R550."

Thermoplastic polyether-ester elastomer: Produced by DuPont-Toray Co., Ltd. under the trade name Hytrel 4001.

Polyisocyanate compound: 4,4'-Diphenylmethane diisocyanate.

Tables 1 and 2 also show values such as the hardness, deflection, and outside diameter for the cores, cover layers and balls in the above examples of the invention and comparative examples. In addition, Tables 1 and 2 show the initial velocity and relative spin rate for each ball when shot with a driver. These measurements and evaluations were carried out as described below.

Hardness Of Individual Cover Layers

The Shore D hardnesses of the cover materials (resin compositions) in the form of sheets, as measured according to ASTM D-2240.

Core and Ball Deflection (mm)

The deflection (mm) when a spherical body is compressed under a final load of 1,275 N (130 kgf) from an initial load state of 98 N (10 kgf).

Initial Velocity of Ball (m/s)

The initial velocity of the ball when hit at a head speed of 54.8 m/s with a driver (TourStage X-Drive 405, manufactured by Bridgestone Sports Co., Ltd.) mounted on a swing robot.

Spin Rate of Ball (rpm)

The spin rate was measured under the same conditions as mentioned above, and the difference of the measured value with respect to the measured value obtained in Comparative Example 3 (which was assigned a reference value of "0") was indicated.

It is apparent from these test results that, compared with the golf balls obtained in Comparative Examples 1 to 4 which fall outside the scope of the invention, the golf balls obtained in Examples 1 to 3 according to the present invention had a high initial velocity and had a sufficient spin rate-lowering effect on shots with a driver.

That is, in Comparative Example 1, the inner cover layer was thin, as a result of which the spin rate on shots taken with a driver was excessive.

In Comparative Example 2, the core was too soft, resulting in a low initial velocity.

In Comparative Example 3, the inner cover layer was formed of a conventional ionomer. This inner cover layer was soft, giving the ball a poor rebound.

In Comparative Example 4, the inner cover layer was formed of a conventional ionomer. The ball had a poor rebound.

The invention claimed is:

1. A three-piece solid golf ball comprising a core obtained by molding under heat a rubber composition comprised of a base rubber, a filler, an organic peroxide, an antioxidant and an α,β-unsaturated carboxylic acid, and an inner cover layer and outer cover layer which encase the core and are made of a thermoplastic resin material, wherein the core has a deflection when compressed under a final load of 1,275 N (130 kgf) from an initial load state of 98 N (10 kgf) of at least 2.6 mm but not more than 3.2 mm; the inner cover layer has a Shore D hardness of more than 58 and is formed of a heated mixture having a melt index of at least 1.0 dg/min and comprising:

100 parts by weight of one or a mixture of (a) an olefin-unsaturated carboxylic acid random copolymer and/or an olefin-unsaturated carboxylic acid-unsaturated carboxylic acid ester random copolymer, and (d) a metal ion neutralization product of an olefin-unsaturated carboxylic acid random copolymer and/or a metal ion neutralization product of an olefin-unsaturated carboxylic acid-unsaturated carboxylic acid ester random copolymer, (b) from 5 to 80 parts by weight of a fatty acid or fatty acid derivative having a molecular weight of at least 228, and (c) from 0.1 to 10 parts by weight of a basic inorganic metal compound which is capable of neutralizing acid groups in components (a) and/or (d) and in component (b);

the outer cover layer has a Shore D hardness of 58 or less; the inner cover layer has a thickness of at least 3 mm and the cover layers have a combined thickness of at least 3.5 mm, wherein the outer cover layer is formed by injection-molding a single resin blend comprising (A) a thermoplastic polyurethane and (B) a polyisocyanate compound, which resin blend contains a polyisocyanate compound in at least some portion of which all the isocyanate groups on the molecule remain in an unreacted state, and wherein the single resin blend consists of a plurality of the same kind of pellets, and wherein the resin blend contains a polyisocyanate compound in at least some portion of which all the isocyanate groups on the molecule remain in an unreacted state by mixing the component (A) and the component (B) in an inert gas or in a vacuum state.

2. The three-piece solid golf ball of claim 1, wherein the outer cover layer-forming resin blend further comprises (C) a thermoplastic elastomer other than a thermoplastic polyurethane.

3. The three-piece solid golf ball of claim 1, wherein the inner cover layer further includes at least one compound of the following (e), (f) and (g), (e) a thermoplastic elastomer selected from the group consisting of thermoplastic polyester elastomers, thermoplastic block copolymers and thermoplastic urethanes, (f) a thermoplastic block copolymer containing end blocks modified by a functional group having reactivity with an ionomer resin, both end blocks being formed of different comonomers, and (g) an inorganic filler which is non-reactive with an ionomer resin.

4. The three-piece solid golf ball of claim 1, wherein while the resin blend is being injection-molded about the core, or due to post-treatment of annealing thereafter, the unreacted isocyanate groups react with component (A) to form a crosslinked material.

5. The three-piece solid golf ball of claim 1, wherein the inner cover layer has a thickness of at least 3.1 mm.

6. The three-piece solid golf ball of claim 1, wherein the unsaturated carboxylic acid content within the random copolymer of component (a) is from 2 to 15 wt %.

* * * * *